US005709634A

United States Patent [19]

Pointer

[11] Patent Number: 5,709,634

[45] Date of Patent: Jan. 20, 1998

[54] DUMBBELL ADAPTED TO BE HELD BEHIND USER'S HEAD WHILE PERFORMING SIT-UPS

[76] Inventor: Randy V. Pointer, P.O. Box 872724, Wasilla, Ak. 99687

[21] Appl. No.: 188,697

[22] Filed: Jan. 31, 1994

[51] Int. Cl.[6] ..... A63B 21/065; A63B 21/075

[52] U.S. Cl. ..... 482/105; 482/106; 482/140

[58] Field of Search ..... 482/10, 93, 106, 482/108, 140, 105

[56] References Cited

U.S. PATENT DOCUMENTS

| | | | |
|---|---|---|---|
| 2,855,202 | 10/1958 | Kinne | 482/10 |
| 3,334,899 | 8/1967 | Bosko et al. | 482/108 |
| 4,168,060 | 9/1979 | Hohenfeldt | 482/10 |
| 4,988,093 | 1/1991 | Forrest, Sr. et al. | 482/10 |
| 5,169,372 | 12/1992 | Tecco | 482/105 |

*Primary Examiner*—Lynne A. Reichard

[57] ABSTRACT

An abdominal exercise apparatus including a substantially flattened concave frame comprising a center portion having internal cavities and two opposing handholds, and furthermore the internal cavities of the center portion are filled with a desired quantity of fluidlike weight additive materials and sealed using a removable plug or cap. The apparatus is held behind the head when performing abdominal exercises including body curls wherein the added weight increases resistance to muscle contraction. In another embodiment one or more incremental weights in the form of annular discoids is affixed to a shaft protruding from the apparatus thereby providing a selection of significantly greater weight for training.

7 Claims, 4 Drawing Sheets

DUMBBELL ADAPTED TO BE HELD BEHIND USER'S HEAD WHILE PERFORMING SIT-UPS

FIELD OF THE INVENTION

1. Field of the Invention

The present invention relates to exercise apparatus and more particularly pertains to abdominal exercise apparatus which may be incorporated into a flexible weighted apparatus held behind one's head during exercises using augmented upper body weight to strengthen or provide for endurance in the abdominal muscle group.

2. Description of the Prior Art

The use of abdominal exercise apparatus is known in the prior art. More specifically, abdominal exercise apparatus heretofore devised and utilized for the purpose of strengthening or otherwise providing muscle tone to the abdominal muscle group are known to consist basically of familiar, expected and obvious structural configurations, notwithstanding the myriad of designs encompassed by the crowded prior art which have been developed for the fulfillment of countless objectives and requirements.

The present invention is directed to improving devices for enhancing abdominal exercise in a manner which is safe, secure, economical and aesthetically pleasing.

For example, U.S. Pat. No. 5,169,372 to Tecco discloses an exercise device comprising a rigid, hand held semi-cylindrical head receiving structure and neck bracing structure engaging the posterior portion of one's head and neck, and thereby providing head support during abdominal exercise. Weight adjustment of the device is accomplished using additional weights emplaced in pockets or otherwise affixed to the device. The present invention comprises a somewhat flexible hand held apparatus positioned behind one's head for the purpose of exercising abdominal muscle groups by providing opposing forces during exercises known as body curls or situps. Advantages of the present invention are the use of lead or steel shot, sand, or water to provide a first level of weight increase, and to provide for additional weight introduction using common barbell type annular discoid weights wherein the discoid weights may be increased in single increments rather than the dual matched increments required by the Tecco invention. Weights added in the present invention have the added advantage of maintaining the center of mass of all weights in a plane substantially perpendicular to a plane including both handholds thereby providing greater stability and safety in operation.

In U.S. Pat. 4,863,158 to Tassone a sit-up exercise aid is disclosed. The Tassone invention comprises a barbell apparatus having a means for disposition of equal annular discoidal weights on two free ends of an elongated bar wherein the bar is curved at a central portion forming a yoke, and furthermore the invention has two handles perpendicularly disposed to the elongated bar for the purpose of maintaining the aid behind the head during a particular form of sit-up exercise. The Tassone aid maintains the lower back in a flattened position throughout the exercise regimen by positioning the hands substantially nine inches from the deltoid muscle group and therefore is limited in abdominal exercise use and is not employable in performing full body curls. The present invention positions the hands substantially aside the ears and is not intended to provide a means for limiting the movement of the lower back therefore a wider range of exercise benefit is obtainable. The present invention also provides improved control of the movement of attached weights by having a center of mass lying in a plane substantially perpendicular to a plane including the handholds.

In U.S. Pat. No. 3,820,780 to Tarbox a head weight and method of use is described. The Tarbox invention comprises an eight to twelve pound weighted fabric headband supported by medial and traverse straps over the top of the head. The Tarbox invention is used to strengthen the neck muscles and is not devised as a tool for the exercise of abdominal muscle groups. The present invention does not attach to the head and is devised to strengthen abdominal muscles and therefore has little or no effect on the neck muscles.

In U.S. Pat. No. 4,752,067 to Colonello an apparatus for use in exercising the abdominal muscles is disclosed for improving the physiological effectiveness of sit-up exercises. The Colonello invention comprises a basin having hand holds and a lower central convex cavity to act as a rocker and to accommodate the tailbone. A disadvantage in this prior art lies in a lack of a means for adding resistance in the form of a weight moment to increase the strength of the various abdominal muscle groups, and furthermore the Colonello apparatus does not readily permit entry into a full sit-up position. The present invention permits addition of weight resistance at the head thereby generating a significant weight moment about the pivot line during sit-up exercises. And furthermore, the present invention permits full or partial situps as desired by the user.

U.S. Pat. No. 5,122,107 to Gardner discloses a situp exercise head-support harness. The disclosure teaches an interconnecting straplike harness having a portion supporting the head, a portion grasped by the hands, and a portion affixed to the body through a series of attachments. The disclosure makes no provision for attaching annular discoidal weights as desired rather it includes a weight purse positioned in the chest region. The addition of weights in the chest region is not as effective in strengthening abdominal muscles as a similar weight located near the head, and furthermore pressure experienced by the chest cavity during exercise and induced by the weight purse is likely to cause shortness of breath and may prove hazardous in lengthy workouts. The present invention locates all weight at the head area and is not devised to support the head therefore the neck muscles are incidental participants in the abdominal exercise as is generally desirable in weight training.

In this respect, the abdominal exercise apparatus according to the present invention substantially departs from the conventional concepts and designs of the prior art, and in so doing provides an apparatus primarily developed for the purpose of exercising the abdominal muscle groups.

Therefore, it can be appreciated that there exists a continuing need for new and improved abdominal exercise apparatus which can be used by individuals with no prior training in the gym, at home, or at diverse locations. In this regard, the present invention substantially fulfills this need.

As illustrated by the background art, efforts are continuously being made in an attempt to improve abdominal exercise apparatus. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of abdominal exercise apparatus now present in the prior art, the present invention provides an improved abdominal exercise apparatus construction wherein the same can be utilized for strengthening and toning the abdominal muscle groups. As such, the general purpose of the present invention, which will be described subsequently in greater detail, is to provide a new and improved abdominal exercise apparatus and method which has all the advantages of the prior art abdominal exercise apparatus and none of the disadvantages.

The invention is defined by the appended claims with the specific embodiment shown in the attached drawings. For the purpose of summarizing the invention, the invention may be incorporated into a hollow, substantially elliptical plate having concavity and two oppositely disposed handgrips. The plate may be filled with weight increments such as steel or lead shot, sand, or water. An optionally emplaced bolt orthogonally engaging the elliptical plate is employed to enable the addition of one or more annular discoidal weights commonly used as incremental weights on barbells. A wingnut or other hand deployable nut threadedly engages the bolt thereby affixing the added weight increment to the elliptical plate. In use the abdominal exercise apparatus is positioned behind the head while the user is lying on the floor. Both hands engage the handgrips and the abdominal exercise apparatus is held in position relative to the head while full or partial situps are performed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved abdominal exercise apparatus.

It is therefore an additional object of the present invention to provide a new and improved abdominal exercise apparatus which has all the advantages of the prior art abdominal exercise apparatus and none of the disadvantages.

It is another object of the present invention to provide a new and improved abdominal exercise apparatus which may be easily and efficiently manufactured and marketed.

It is a further object of the present invention to provide a new and improved abdominal exercise apparatus which is of a durable and reliable construction.

An even further object of the present invention is to provide a new and improved abdominal exercise apparatus which is susceptible of a low cost of manufacture with regard to both materials and labor, and which accordingly is then susceptible of low prices of sale to the consuming public, thereby making such abdominal exercise apparatus economically available to the buying public.

Still yet another object of the present invention is to provide a new and improved abdominal exercise apparatus which provides in the apparatuses and methods of the prior art some of the advantages thereof, while simultaneously overcoming some of the disadvantages normally associated therewith.

Still another object of the present invention is to provide a new and improved abdominal exercise apparatus having enhanced physical stability thereby improving safety and effectiveness.

Yet another object of the present invention is to provide a new and improved abdominal exercise apparatus enabling the user to adjust the weight of said apparatus over wide ranges thereby providing a weight training aid with selectible resistance.

Even still another object of the present invention is to provide a new and improved abdominal exercise apparatus wherein said apparatus is manufacturable using a high volume injection molding process.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
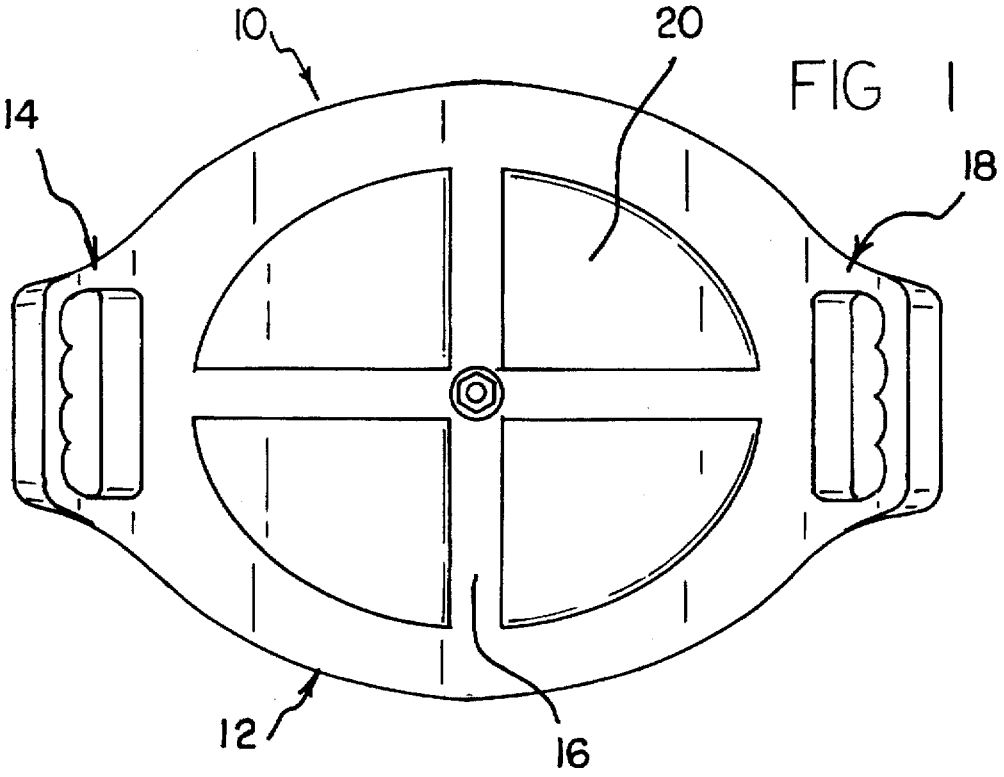
FIG. 1 is a top view of the abdominal exercise apparatus.

With reference now to the drawings, and in particular to FIG. 1 thereof, a new and improved abdominal exercise apparatus embodying the principles and concepts of the present invention and generally designated by the reference numeral 10 will be described.

Figure 2:
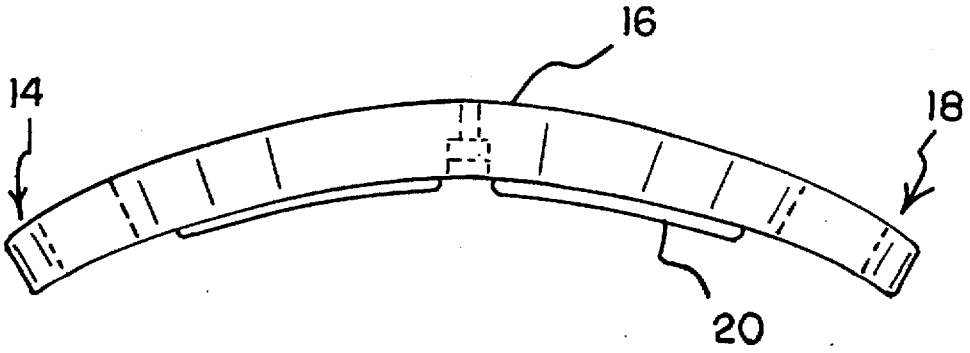
FIG. 2 is a side elevational view of the abdominal exercise apparatus in an inverted position showing the head pads.

From an overview standpoint, the abdominal exercise apparatus is adapted for use by humans for augmenting exercises strengthening or otherwise providing muscle tone of the abdominal muscle groups. See FIGS. 1 and 2. The abdominal exercise apparatus 10 comprises a frame 12 having a first portion 14 comprising a handhold, a second portion 16 containing weight ballast and having attached soft pads 20 to protect the head, and a third portion 18 comprising an opposite handhold. The abdominal exercise apparatus 10 has a slight concavity thereby providing a cradle support for the head, and additionally precludes contact of the knuckles with the ground during situp exercises. As can be seen in the various Figures, the central portion has a larger dimension at a center and tapers toward the end portions thereof. In use, the abdominal exercise apparatus 10 is held in position behind the head, concave side facing upward, using both hands while in the supine position. The abdominal exercise apparatus 10 is held substantially in position behind the head as the body transitions from a supine position to a non-toe touch pike position.

Figure 3:
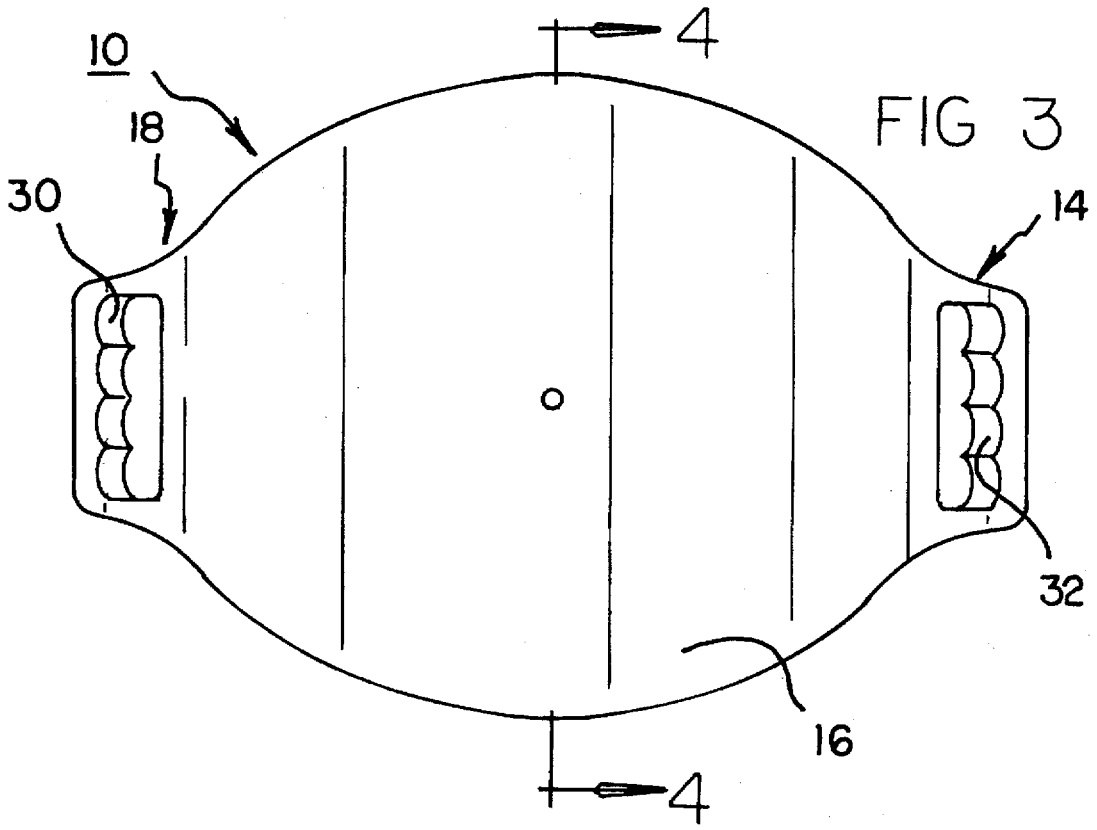
FIG. 3 is bottom view of the abdominal exercise apparatus.
Figure 4:
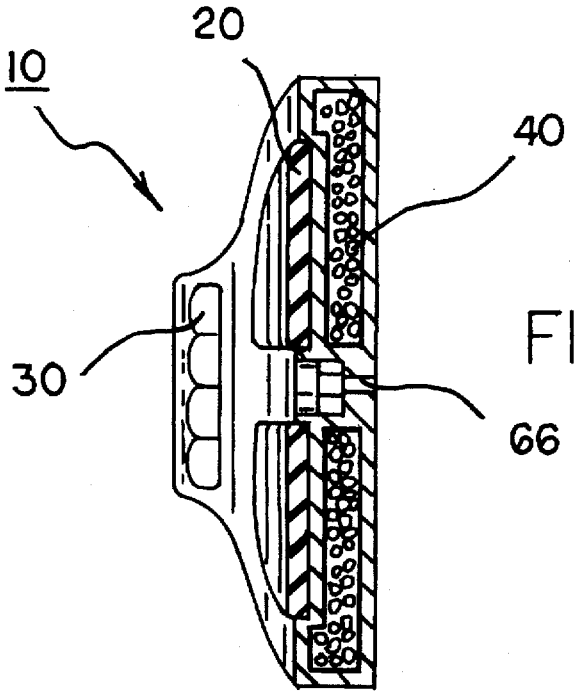
FIG. 4 is a side sectional view of the abdominal exercise apparatus taken substantially upon the plane indicated by the section lines 4—4 of FIG. 3.

More specifically, it will be noted that the abdominal exercise apparatus 10 comprises a frame 12 of durable polymeric composition providing satisfactory service for several years. Some polymers useful in fabrication of frame 12 are polyvinylidine chloride, polyurethane, and hard rubber. First portion 14 of frame 12 is perforated by a slot thereby forming handhold 30. See FIG. 3. Handhold 30 is contoured and of sufficient dimension to comfortably accommodate a wide range of hand sizes and grip styles.

First portion 14 is generally of solid construction, however, hollow cavities may be introduced as indicated by cost, strength, and durability of the materials of construction. Second portion 16 comprises a substantially hollow supportive structure filled with weight ballast 40.

Weight ballast 40 comprises a multiplicity of steel or lead shot, sand, water, or other more or less finely divided material of high specific density and being capable of filling the interior spaces of second portion 16 thereby providing a substantial weight increase to abdominal exercise apparatus 10.

Second portion 16 also has affixed a plurality of cushioning pads 20 which are adhesively adjoined to top the second portion 16 in a disposition providing a soft interface between said second portion 16 and the head. Cushioning pads 20 may be of neoprene, polyurethane foam, or a variety of other material construction and furthermore pads 20 may be removably affixed to second portion 16 using hook and loop coacting fasteners.

Figure 6:
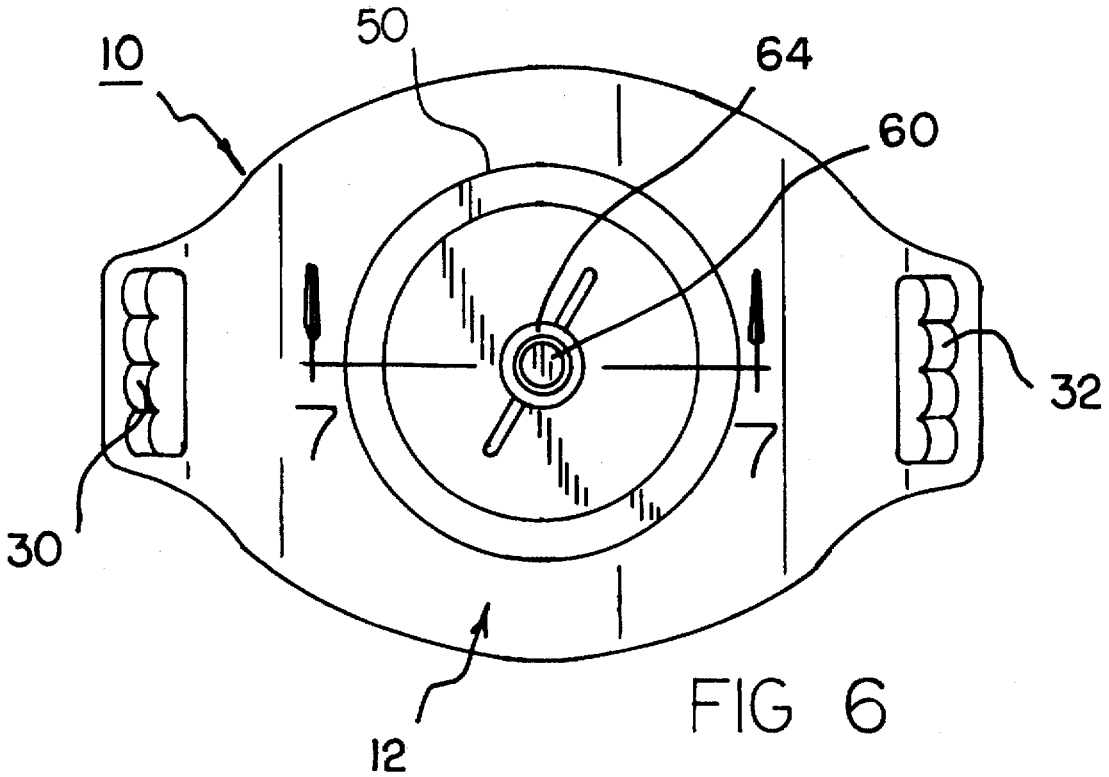
FIG. 6 is a bottom view of the alternate embodiment of a abdominal exercise apparatus showing the attachment of annular discoidal incremental weights.
Figure 5:
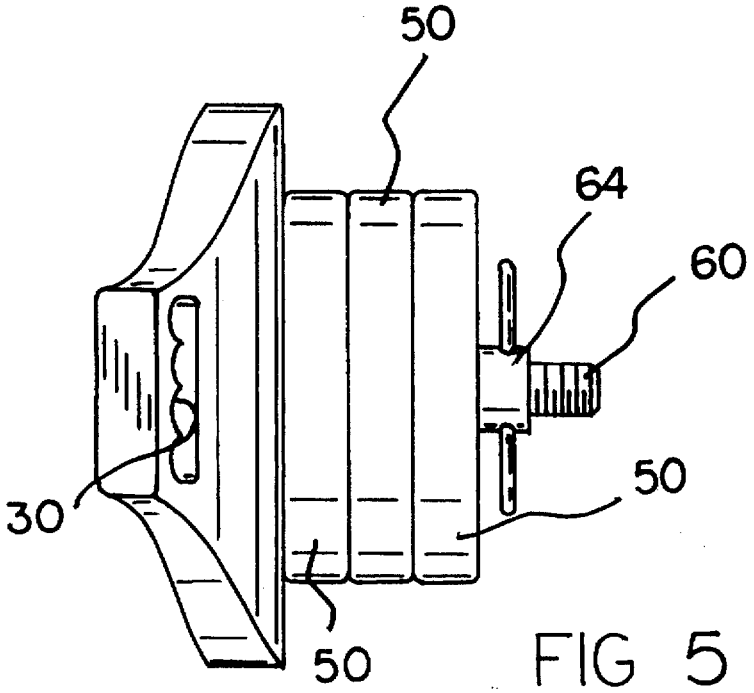
FIG. 5 is a side elevational view of the alternate embodiment of an abdominal exercise apparatus showing the attachment of annular discoidal incremental weights.

In an alternate embodiment, additional incremental weight 50 may be applied. See FIGS. 5 and 6. Incremental weight 50 is of an annular discoid construction as typically employed in barbell sets wherein the weight comprises a cast iron or steel disc having a central hole for mounting upon the barbell lifting shaft. Water or sand filled annular discoidal incremental weights 50 are also usable.

Figure 7:
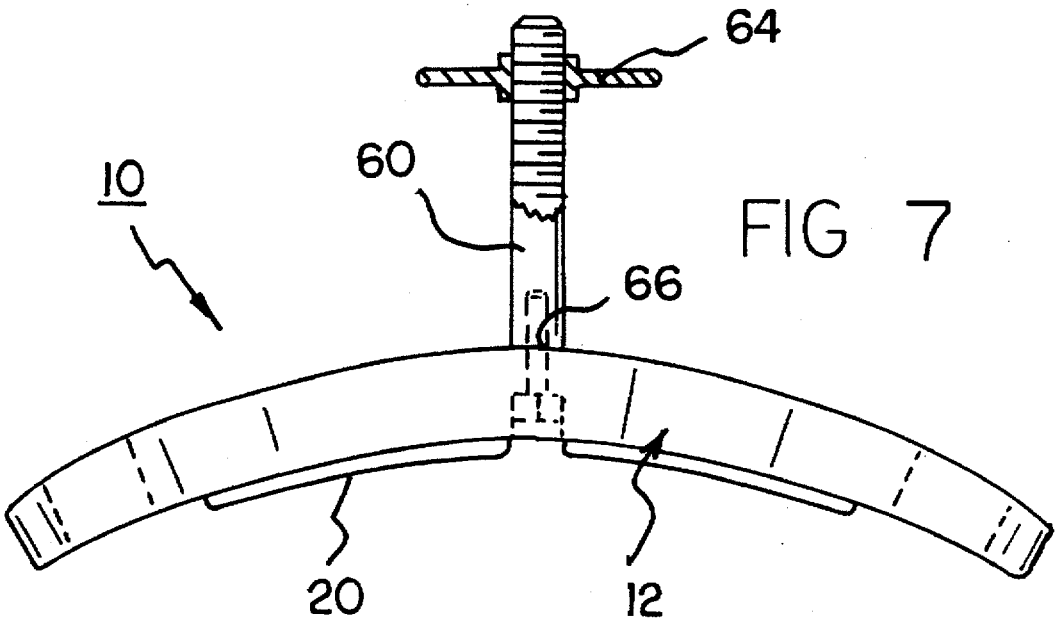
FIG. 7 is a side sectional view of an alternate embodiment of the abdominal exercise apparatus showing the incremental weight attaching bolt and nut.
Figure 8:
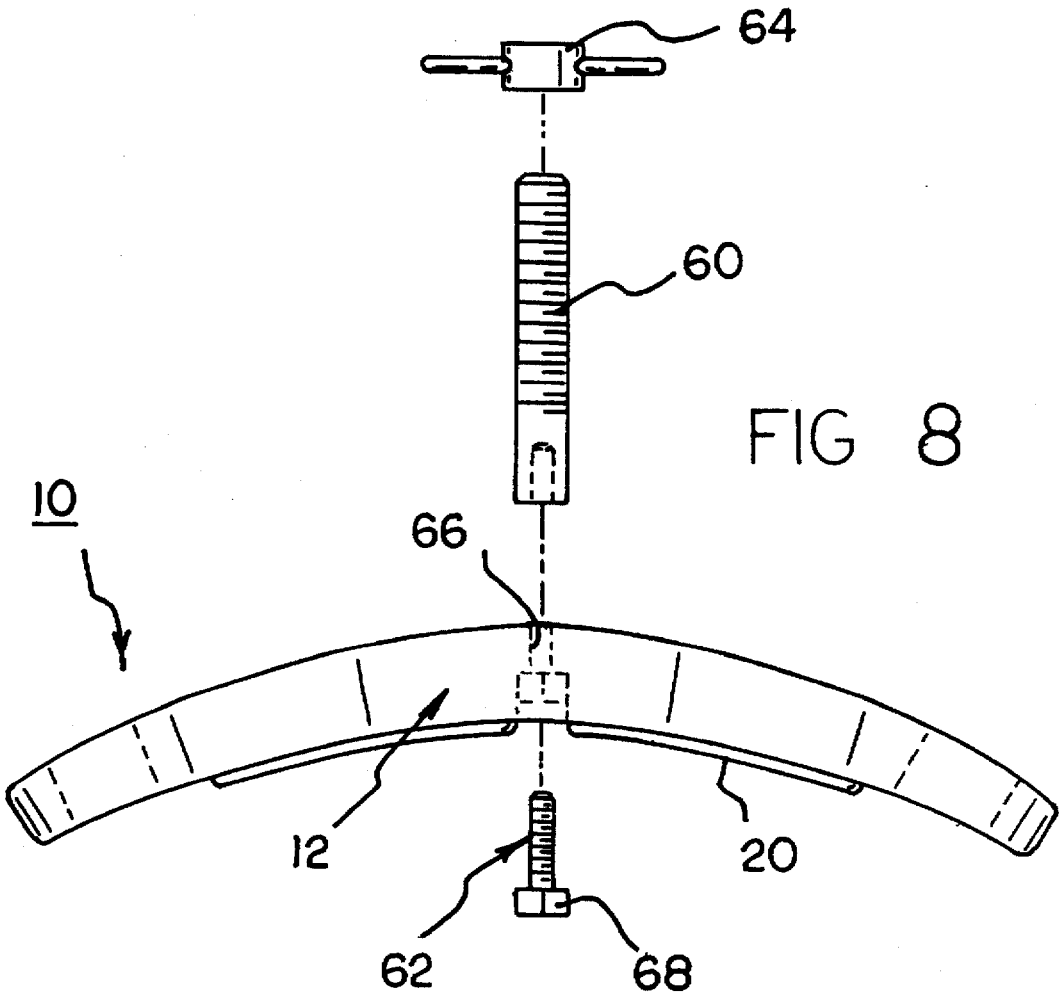
FIG. 8 is an exploded side elevational view of the alternate embodiment of the abdominal exercise apparatus.

One or more incremental weights 50 may be added to increase resistance as desired in a particular exercise regimen. Incremental weights 50 are affixed to frame 12 using a bolt 62 threadedly engaging a weight retaining shaft 60. See FIGS. 7 and 8. A through hole 66 having a shoulder and a rotational interference engagement with the flat portions of bolt head 68 is provided in the center of frame 12.

Shaft 60 may be rotated engaging bolt 62 which passes partially through hole 66 of frame 12 until a degree of tightness is acquired wherein the shaft 60 is firmly affixed to frame 12. Incremental weights may subsequently be emplaced over the shaft wherein the frame 12 is lying in a flat inverted position. Wingnut 64 threadedly engages shaft 60 thereby affixing one or more incremental weights 50 to abdominal exercise apparatus 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved abdominal exercise apparatus for use by humans to improve and add resistance in abdominal muscle group exercises comprising:

a frame having a first end portion, a central portion, and a second end portion wherein said first end portion comprises a hand griping means, said central portion has a larger dimension at a center and tapers toward the end portions thereafter, said central portion having one or more internal cavities capable of being filled with a variable quantity of substantially fluidic weights, and said second end portion comprises a hand gripping means being substantially a mirror image of said first end portion, and furthermore said frame has a top portion and a bottom portion wherein the top portion is adapted to engage the head of a human user and both the top portion and the bottom portion have a substantially fixed concavity directed toward the head, and a cushioning means disposed adjacent to the frame top portion and adapted to engage the head of a human user, said cushioning means comprising one or more polymeric pads being generally of slight thickness and furthermore being adhesively affixed to said frame top portion, said cushioning means being cohesively affixed to said frame top portion using coacting fasteners wherein said coacting fasteners have hook-like projections on one part engaging a corresponding pile section on another part thereby rendering said cushioning means replaceable.

2. The new and improved abdominal exercise apparatus of claim 1 wherein said central portion has one or more internal cavities capable of being filled with a variable quantity of substantially fluidic weights.

3. The new and improved abdominal exercise apparatus of claim 1 in which said fluidic weights are metal balls of small diameter.

4. The new and improved abdominal exercise apparatus of claim 1 in which said fluidic weights are great numbers of sand particles.

5. The new and improved abdominal exercise apparatus of claim 1 wherein said fluidic weights are aqueous liquids.

6. The new and improved abdominal exercise apparatus of claim 1 in which said fluidic weights are introduced and removed by the user, and furthermore one or more fill holes and corresponding sealing means are disposed upon the frame central portion wherein the fill holes penetrate from a first surface of the frame central portion to an internal cavity.

7. A new and improved abdominal exercise apparatus for use by humans to improve and add resistance in abdominal muscle group exercises comprising:

a frame having a first end portion, a central portion, and a second end portion wherein said first end portion comprises a hand griping means, said central portion has a larger dimension at a center and tapers toward the end portions thereafter, and said second end portion comprises a hand gripping means being substantially a mirror image of said first end portion, and furthermore said frame has a top portion and a bottom portion wherein the top portion is adapted to engage the head of a human user and both the top portion and the bottom portion have a substantially fixed concavity directed toward the head, and a cushioning means disposed adjacent to the frame top portion;

a bolt threadedly engaging a weight retaining shaft and securing the weight retaining shaft to the frame central portion;

a stepped central portion through hole having a portion which provided rotational interference with an end of said bolt; and a wingnut threadedly engaging the weight retaining shaft and engaging any incremental weights affixed thereon thereby removably affixing said incremental weights to said frame.

* * * * *